United States Patent [19]

Gregory, Jr. et al.

[11] Patent Number: 4,504,978

[45] Date of Patent: Mar. 19, 1985

[54] DISPOSABLE SURGICAL GOWN SLEEVE

[76] Inventors: Paul E. Gregory, Jr.; Roger N. White, both of 6300 Center Hill Rd., Cincinnati, Ohio 45224

[21] Appl. No.: 490,095

[22] Filed: Apr. 29, 1983

[51] Int. Cl.[3] ..... A41D 27/16

[52] U.S. Cl. ..... 2/59; 2/114; 2/DIG. 7

[58] Field of Search ..... 2/59, 114, DIG. 7, 87, 2/51; 361/220, 223; 428/198

[56] References Cited

U.S. PATENT DOCUMENTS

| | | | |
|---|---|---|---|
| 1,326,630 | 12/1919 | Barker . | |
| 2,319,085 | 5/1943 | Plant | 2/87 |
| 2,372,632 | 3/1945 | Webb | 154/42 |
| 2,668,294 | 2/1954 | Gilpin | 2/114 |
| 2,988,457 | 6/1961 | Gatcomb | 117/68 |
| 3,011,172 | 12/1961 | Tames | 2/51 |
| 3,026,225 | 3/1962 | Ostby, Jr. | 154/50 |
| 3,090,047 | 5/1963 | Grazia | 2/275 |
| 3,169,899 | 2/1965 | Steuber | 428/198 |
| 3,209,983 | 10/1965 | Bellezanne | 229/53 |
| 3,218,649 | 11/1965 | Ricter | 2/114 |
| 3,349,285 | 10/1967 | Belkin | 317/2 |
| 3,410,266 | 11/1968 | Krzewinski et al. | 128/132 |
| 3,563,198 | 2/1971 | Johnston | 112/402 |
| 3,574,238 | 4/1971 | McCurry | 2/243 |
| 3,657,741 | 4/1972 | Blanco | 2/DIG. 7 |
| 3,803,640 | 4/1974 | Ericson | 2/114 |
| 3,837,995 | 9/1974 | Floden | 161/150 |
| 3,868,728 | 3/1975 | Krzewinski | 2/114 |
| 3,916,447 | 11/1975 | Thompson | 2/46 |
| 4,114,200 | 9/1978 | Smith et al. | 2/51 |
| 4,196,245 | 4/1980 | Kitson et al. | 428/198 |
| 4,214,320 | 7/1980 | Belkin | 2/114 |

*Primary Examiner*—Doris L. Troutman

[57] ABSTRACT

A gown sleeve has a zone which extends from a lower end proximate the wrist end of the sleeve to an upper end above the elbow area of the sleeve. The zone comprises an outer layer of base sleeve material, an inner layer of sleeve lining material, and a mid layer of barrier material. The barrier material is a water-repellent, air-porous nonwoven fabric web which is encased between the outer and inner layers. The sleeve zone further comprises a first bond around the sleeve at the lower end of the zone and a second bond around the sleeve at the upper end of the zone. These bonds bond the outer and inner layers to one another while the mid layer is excluded from the bonds.

19 Claims, 9 Drawing Figures

DISPOSABLE SURGICAL GOWN SLEEVE

TECHNICAL FIELD

This invention relates to sleeves for garments, especially for disposable surgical gowns, the sleeves having a zone of enhanced water repellency, and to processes for making such sleeves.

BACKGROUND OF THE INVENTION

The use of water-repellent and water-impermeable barriers in conjunction with fabrics to prevent penetration by water or water-based liquids of garments or particular sections of garments, especially surgical gowns, has long been known. General water repellency of fabrics can be achieved by treating the fabric with waterproofing chemicals. Such water repellency treatments for surgical gown fabrics are disclosed in U.S. Pat. No. 2,668,294 issued to Gilpin on Feb. 9, 1954, U.S. Pat. No. 3,218,649 issued to Ricter on Nov. 23, 1965, U.S. Pat. No. 3,229,305 issued to Nevitt on Jan. 18, 1966, and U.S. Pat. No. 3,349,285 issued to Belkin on Oct. 24, 1967. Such water repellency treatments are generally not complete barriers to the passage of water in that a sufficient pressure can cause water to penetrate such water-repellent fabrics. A water-impermeable surgical gown can be achieved by the use of a plastic film as disclosed in Ricter.

Water-repellent fabrics provide a sufficient water barrier in most regions of a surgical gown. However, certain regions of the gown are exposed to a combination of large amounts of liquid contact and pressure applied due to contact of the wearer with the surgical table or patient. These regions, which are the central operative region of the upper gown front and the lower sleeves, are particularly susceptible to liquid penetration of the fabric (hereinafter generally referred to as "liquid strikethrough"). Where liquid strikethrough occurs, there is an increased danger of contamination and resulting infection for the patient.

Extra layers of water-repellent and water-impermeable materials have been placed on the central operative region and lower sleeves of surgical gowns in order to provide added protection against liquid strikethrough in these critical areas. References which disclose such zones of protection are U.S. Pat. No. 3,011,172 issued to Tames on Dec. 5, 1961; U.S. Pat. No. 3,359,569 issued to Rotanz, Scrivens and Hanlon on Dec. 26, 1967; U.S. Pat. No. 3,803,640 issued to Ericson on Apr. 16, 1974; U.S. Pat. No. 3,868,728 issued to Krzewinski on Mar. 4, 1975; U.S. Pat. No. 4,171,542 issued to Cox, Johnson, Maskey and Mueller on Oct. 23, 1979; and U.S. Pat. No. 4,214,320 issued to Belkin on July 29, 1980.

In recent years disposable surgical gowns have increased in usage in order to avoid laundering and sterilizing of reusable gowns. Also, the disposable gowns can be more easily treated to water-repellency and water-impermeability since they do not have to withstand repeated laundering and sterilization. However, since such disposable surgical gowns are used only once, the materials from which they are made and the processes for making them must be kept as inexpensive as possible in order to make the disposable gowns affordable.

Nonwoven fabric laminates utilizing webs of microfine hydrophobic fibers have recently come into use as fabrics which are highly water-repellent while still moderately air-porous. Examples of such webs are meltblown webs of the type taught in the article entitled "Superfine Thermoplastic Fibers" by Van A. Wente, appearing in *Industrial Engineering Chemistry,* August, 1956, Vol. 48, No. 8 (pp. 1342–1346 ). Fabrics incorporating such webs for use as fluid barriers are disclosed in U.S. Pat. No. 3,837,995 issued to Floden on Sept. 24, 1974; U.S. Pat. No. 3,916,447 issued to Thompson on Nov. 4, 1975; and U.S. Pat. No. 4,196,245 issued to Kitson, Gilbert and Israel on Apr. 1, 1980; and in copending application Ser. No. 401,169 filed July 23, 1982, in the names of Sneed, Schwam and Gregory.

SUMMARY OF THE INVENTION

It is an object of the present invention to provide a disposable surgical gown sleeve having excellent water repellency to help prevent liquid penetration of the sleeve.

It is a further object of the present invention to provide such a sleeve having adequate air porosity to provide good comfort for the gown wearer.

It is still a further object of the present invention to provide such a sleeve with adequate flexibility to avoid impairment of movement of the arms of the wearer.

It is a further object of the present invention to provide such a sleeve having adequate strength.

It is also an object of the present invention to provide an economic method for manufacturing such sleeves for disposable surgical gowns.

These and other objects will become apparent from the detailed description of the invention.

The invention described herein is a gown sleeve; the sleeve has a wrist end, an elbow area, and a shoulder end. The sleeve has a zone which extends from a lower end proximate the wrist end of the sleeve to an upper end above the elbow area of the sleeve. The sleeve zone comprises an outer layer of base sleeve material, an inner layer of sleeve lining material, and a mid layer of barrier material, the barrier material being a water-repellent, air-porous nonwoven fabric web. The mid layer is encased between the outer and inner layers. The sleeve zone further comprises a first bond around the sleeve at the lower end of the sleeve zone and a second bond around the sleeve at the upper end of the sleeve zone. The first and second bonds bond the outer and inner layers to one another. The mid layer is excluded from the first and second bonds.

DETAILED DESCRIPTION OF THE INVENTION

Figure 1:
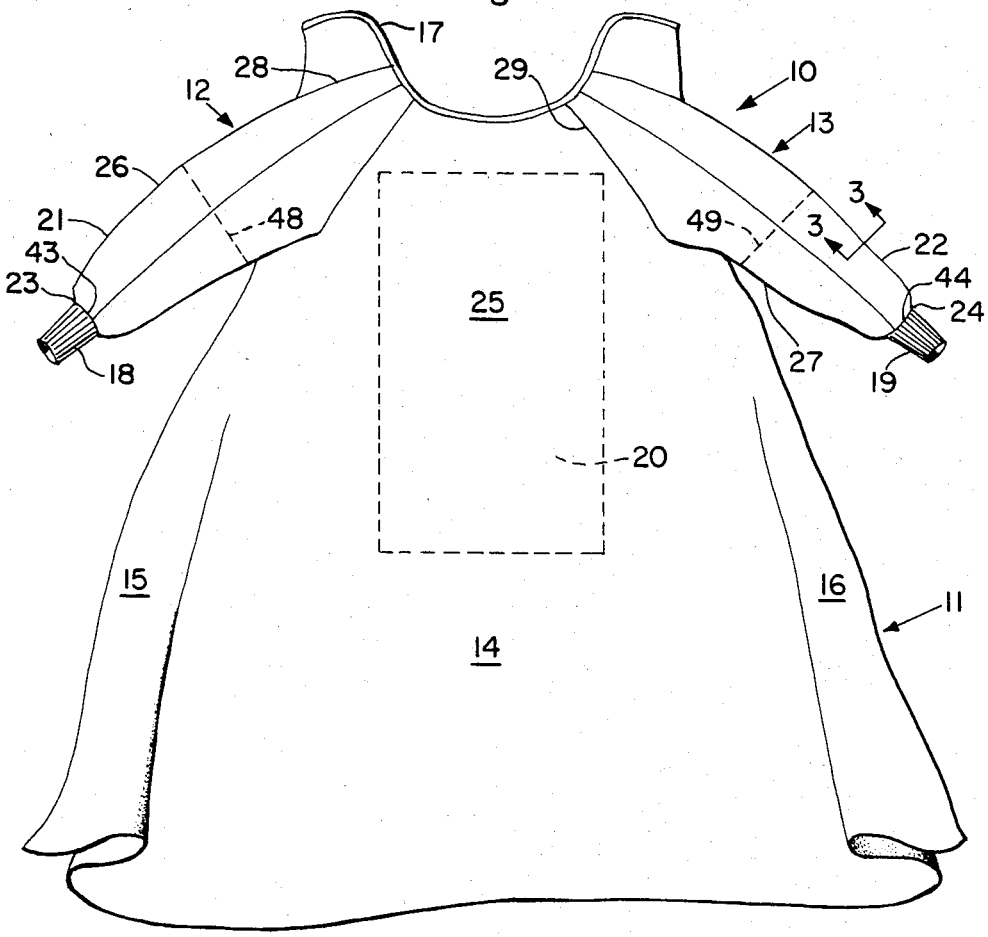
FIG. 1 is an elevational view of a surgical gown having zones of enhanced water-repellency in the lower sleeves and water-impermeability in the central operative region of the upper gown front.

A surgical gown 10 is illustrated in FIG. 1. Gown 10 comprises a body covering portion 11 and sleeves 12 and 13. Gown 10 is of the back-closing type so that body portion 11 comprises a front portion 14 and side portions 15 and 16 which close and overlap at the back of the wearer. The neck of gown 10 may be provided with a lining tape 17 for strength and comfort.

While not necessarily so limited, since the surgical gown of primary interest herein is intended to be a single-use, disposable gown, it is preferred that the base gown material from which most of the gown parts are made be a nonwoven fabric, especially a nonwoven fabric laminate. In order to provide a gown that is comfortable for the wearer, the base gown material is preferably light in weight and preferably has a high air porosity. The base gown material is preferably water repellent to provide protection from liquid and bacterial strikethrough, abrasion resistant, and low linting. Excellent results are achieved, for example, when the base gown material is a water-proofed tissue laminate. In a preferred embodiment, body portion 11 and preferably also sleeves 12 and 13 of gown 10 comprise a base gown material which is a nonwoven fabric laminate such as the tissue laminates described in U.S. Pat. No. 4,113,911 issued to LaFitte and Camden on Sept. 12, 1978, the specification of which is hereby incorporated by reference. In an especially preferred embodiment, body portion 11 and preferably also sleeves 12 and 13 of gown 10 comprise a base gown material which is a nonwoven fabric laminate such as the nonwoven fabric laminates disclosed in copending patent application Ser. No. 474,417, in the names of Crenshaw, Schlintz, and Moore, the specification of which is hereby incorporated by reference.

The nonwoven fabric laminate used as the base gown material in gowns of the present invention preferably has an air porosity of at least about 200 l/sec/m$^2$, more preferably at least about 250 l/sec/m$^2$. Such laminate also preferably has a liquid strikethrough resistance of at least about 150 mm $H_2O$, more preferably of at least about 200 mm $H_2O$, and a basis weight preferably of no more than about 85 g/m$^2$, more preferably of no more than about 70 g/m$^2$, more preferably still of no more than 60 g/m$^2$.

The various seams of gown 10 may be sewn, or accomplished through the use of appropriate adhesive means, or by heat sealing if at least some of the parts are made of heat-sealable material.

CENTRAL OPERATIVE REGION ZONE

The upper, central part 25 of front portion 14 of gown 10 is a part of the gown termed the central operative region; central operative region 25 is frequently subjected to increased pressure during an operation due to the wearer contacting the operating table or patient with this region of the gown. If liquids such as water, blood, serum, etc., are also contacted by central operative region 25 of gown 10, as often happens, there is an enhanced possibility of liquid penetration (strikethrough) of the normally water-repellent base gown material. To prevent liquid penetration of the entire gown thickness in central operative region 25, a layer of water-impermeable material, such as patch 20, is adhered to gown 10 covering central operative region 25 of gown 10. Patch 20 may be adhered to either the inside or outside of the base gown material; adherence of patch 20 inside the base gown material is preferred.

Central operative region 25 of gown 10 does not cover a part of the body of the wearer which undergoes substantial muscular activity during a surgical procedure; therefore, this body area does not produce such a heat load that an air-porous covering is generally necessary for comfort. Therefore, patch 20 covering central operative region 25 of gown 10 can be a water-impermeable patch in order to provide maximum strikethrough protection without causing undue discomfort to the wearer.

Any lightweight, flexible, water-impermeable material may be used for patch 20. Thermoplastic polymeric films are inexpensive and are a preferred material for patch 20. However, such film applications to the central operative region of a gown are frequently found unacceptable to wearers of such gowns, because they result in an unacceptable stiff, noisy, uncomfortable gown.

Applicants have found that a thermoplastic polymeric material especially suitable for providing a water-impermeable layer to the central operative region of a disposable surgical gown is an ethylene methylacrylate (EMA) polymeric film. Such EMA film is available, for example, from Consolidated Thermoplastics Company of Chippewa Falls, Wisc., under the specification Style SF-10. Such EMA film is very soft, produces very little noise upon contact with other surfaces, and resists wrinkling when folded. The EMA film retains these properties when laminated discontinuously to other materials.

The EMA film used as a water-impermeable layer in gowns of the present invention is preferably less than about 0.13 mm in thickness, otherwise the film is stiff and heavy and very noticeable to the wearer of the gown. An especially preferred EMA film thickness for application to the surgical gown of the present invention is from about 0.01 mm in thickness to about 0.05 mm in thickness; this provides a film that is almost imperceptible to the wearer because of its softness and lack of noise when it is added as a layer attached to the inside of the base gown material.

Even thinner EMA films of less than 0.01 mm in thickness will provide the desired water-impermeable barrier when added as a layer to the base gown material; however, such thinner EMA films are difficult to apply to central operative region 25 using mechanized equipment. One way that such thin films can be applied to the gown is to first apply the film to a layer of nonwoven fabric and then apply the two-ply laminate as a water-impermeable patch to the gown. This has the economic disadvantage of using another layer of material and requiring an extra processing step; it is generally more costly than using a somewhat thicker layer of EMA film which can be applied to the base gown material alone.

Figure 2:
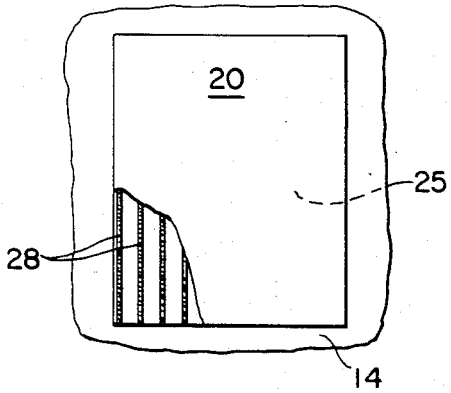
FIG. 2 is a fragmentary view of the inside of the upper front of the surgical gown of FIG. 1 illustrating the water-impermeable polymer patch covering the central operative region.

FIG. 2 shows a preferred method for adhering a thermoplastic polymer film patch on the inside of central operative region 25 of gown 10. Patch 20 is adhered to the base gown material by a series of vertical adhesive strips 28 spaced about 2.5 cm apart. This intermittent adhesive pattern provides enhanced flexibility, thus reducing stiffness of the base gown material-film patch laminate as compared to an overall adhesive pattern covering the entire patch area. By attaching patch 20 with only vertical strips 28 of adhesive, vertical air passageways between the film and the base gown material are provided to aid in cooling the part of the gown wearer covered by patch 20. Also, vertical adhesive strips 28 can be readily applied by mechanical means to either the base gown material in central operative region 25 or film patch 20 during the gown manufacturing operations.

LOWER SLEEVE ZONE

Sleeve 12 of gown 10 has wrist end 23 to which cuff 18 is preferably attached, elbow area 26 which covers the elbow of the wearer, and shoulder end 28 where sleeve 12 is attached to body covering portion 11 of gown 10. Sleeve zone 21 includes at least the lower portion of sleeve 12; it extends from lower end 43 proximate wrist end 23 of sleeve 12 to upper end 48 above elbow area 26 of sleeve 12, preferably ending just above the elbow of the wearer. Sleeve 13 has corresponding parts: wrist end 24, cuff 19, elbow area 27, shoulder end 29, and sleeve zone 22 having lower end 44 and upper end 49.

The lower arms of surgical personnel are areas of substantial muscular activity during a surgical procedure. There is a resulting need to dissipate a substantial heat load from that area of the wearer's body. Also, the cuff ends of the gown sleeves are generally tight and often covered by surgeons' gloves such that very little or no air flow can occur in the lower arm area except through the gown material. Thus, air-porosity of the lower sleeve of surgical gown 10 is highly desirable in order to achieve proper cooling of the lower arm of the wearer. Sleeve zones 21 and 22 of gown 10 have a layer of base sleeve material which is preferably the same as the base gown material, and a layer of a water-repellent, air-porous nonwoven fabric web. The web provides enhanced water-repellency to sleeve zones 21 and 22 compared to that provided by the base sleeve material alone.

Materials which applicants have found to be especially suitable for use in providing the combination of water-repellency and air porosity for sleeve zones 21 and 22 are nonwoven fabric webs of microfine hydrophobic fibers as described hereinabove. Such webs have fibers having a fiber diameter of up to about 10 microns; examples of such webs are melt-blown thermoplastic webs.

Melt-blown webs are not water-impermeable, but provide enhanced water-repellency when layered with water-repellent gown fabrics. Melt-blown webs are preferred over thermoplastic polymeric films when air-porosity is desired, along with enhanced water-repellency, to make the fabric more comfortable for the wearer. Such webs preferably have a liquid strike-through resistance of at least about 200 mm $H_2O$, more preferably of at least about 250 mm $H_2O$, more preferably still of at least about 380 mm $H_2O$; and preferably have an air porosity of at least about 100 l/sec/m$^2$, more preferably of at least bout 250 l/sec/m$^2$, more preferably still of at least about 400 l/sec/m$^2$.

The preferred melt-blown thermoplastic webs for use in gowns of the present invention are made from microfine fibers of polypropylene, polyester, polyethylene or nylon; especially preferred is polypropylene. The preferred melt-blown polypropylene webs used in the present invention have fiber diameters of from about 2 microns to about 7 microns. The preferred melt-blown polypropylene webs used in the present invention have basis weights of from about 10 g/m$^2$ to about 30 g/m$^2$; especially preferred are basis weights of from about 15 g/m$^2$ to about 25 g/m$^2$. Such melt-blown webs are available commercially, for example, as Polyweb® from Riegel Products Corp., Milford, N.J.

Melt-blow webs, especially melt-blown polypropylene webs, generally have poor abrasion resistance; therefore, it is almost always desirable to cover the melt-blown webs with another layer of material having greater abrasion resistance. The nonwoven fabric laminates preferably used as base gown material for surgical gowns of the present invention are generally designed to be used as the outer fabric of the gown in that they possess good water-repellency and abrasion resistance characteristics. Therefore, it is generally preferable to locate patches of melt-blown webs used to provide enhanced water-repellency on the inside of the base gown material.

Melt-blown webs are uncomfortable when in direct contact with the skin of the wearer. Therefore, when this material is attached to the inside of the base gown material in areas where the bare skin of the wearer often contacts the gown, such as the gown sleeve; it is preferable to provide a lining of some other material to cover the melt-blown web on the inside of the gown.

Figure 3:
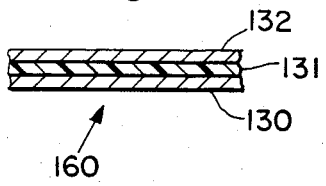
FIG. 3 is a fragmentary cross-sectional view taken along section line 3—3 of the lower sleeve of the gown of FIG. 1.

FIG. 3 is a cross-section view of layered sleeve material 160 taken along section line 3—3 of sleeve zone 22 of gown 10. Layered sleeve material 160 has an outer layer 130 of base sleeve material, an inner layer 132 of sleeve lining material, and a mid layer 131 of barrier material which is a water-repellent, air porous nonwoven fabric web, preferably of microfine hydrophobic fibers, e.g. a melt-blown web. Because of the poor abrasion resistance and objectionable feel characteristics of melt-blown webs when next to the skin, mid layer 131 is preferably encased between outer layer 130 and inner layer 132.

It is important that sleeve zones 21 and 22 of gown 10 have good flexibility so that they do not feel stiff on and impair movement of the arms of the wearer. Flexibility of sleeve zones 21 and 22 is enchanced by leaving the three layers of layered sleeve material 160 substantially unbonded to one another throughout most of the area of zones 21 and 22. Outer layer 130 and inner layer 132 are bonded to one another, for example, at a first bond around sleeve 13 at lower end 44 of sleeve zone 22, and at a second bond around sleeve 13 at upper end 49 of sleeve zone 22, by the use, for example, of adhesives or heat sealing. Because mid layer 131 generally has lower strength than outer layer 130 and inner layer 132, it is preferable that mid layer 131 be excluded from such bonds where outer layer 130 and inner layer 132 are bonded together; this results in stronger bonds. When mid layer 131 is a melt-blown web, it generally has a naturally tacky surface such that where it is layered between outer layer 130 and inner layer 132, the layers will be lightly adhered to one another and mid layer 131 will generally remain flat between outer layer 130 and inner layer 132 even though it is not bonded to either layer by a bonding agent or by heat sealing.

Outer layer 130 is a base sleeve material which is preferably the base gown material described hereinabove, a nonwoven fabric lamminate that is abrasion-resistant and water-repellent. Mid layer 131 is preferably a barrier material which is a nonwoven fabric web of microfine hydrophobic fibers having a fiber diameter of up to about 10 microns, such as a melt-blown web. Inner layer 132 is a sleeve lining material which does not generally substantially enhance the liquid barrier properties of sleeve zones 21 and 22, but it protects mid layer 131 from abrasion and separates it from the skin of the wearer. Sleeve lining material 132 is preferably selected such that it provides enhanced strength to sleeve zones 21 and 22; such enhanced strength is often desired because the lower sleeve regions of a surgical gown are frequently subjected to high stress during gowning and gloving of the wearer. Preferred materials used for inner layer 132 are another layer of nonwoven fabric laminate such as that used for outer layer 130 and nonwoven fabrics, including spunbond webs. Especially preferred are spunbond polyester or nylon webs having a basis weight of from about 20 $g/m^2$ to about 35 $g/m^2$. Such spunbond webs are available commercially, for example, from Asahi Chemical Industry Company Ltd. of Osaka, Japan.

SLEEVE MANUFACTURING METHOD

Figure 4:
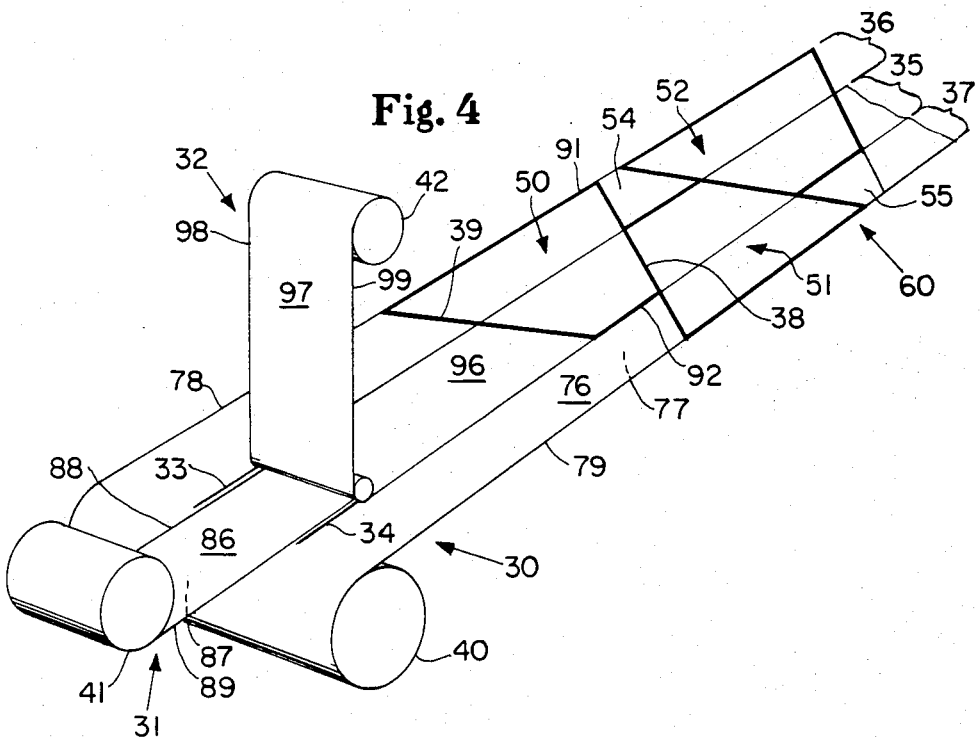
FIG. 4 is a schematic view of a preferred process for producing a preferred layered sleeve material for gown sleeves and for cutting individual sleeve sections therefrom.
Figure 5:
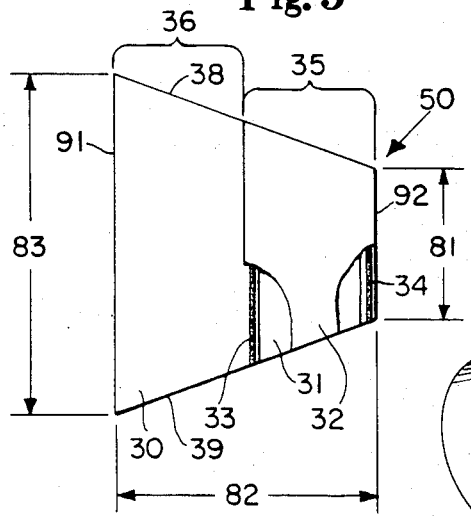
FIG. 5 is a fragmentary view of a preferred individual sleeve section from the layered sleeve material produced by the process of FIG. 4.
Figure 6:
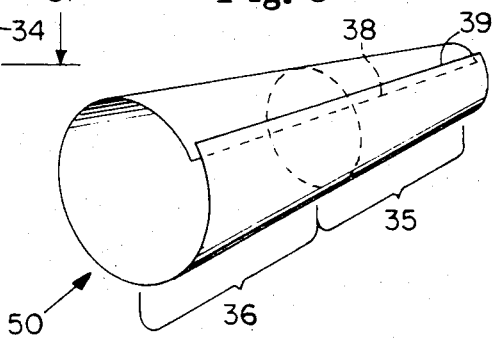
FIG. 6 is a perspective view of a gown sleeve made from the individual sleeve section of FIG. 5.

A preferred method for manufacturing sleeves for garments, especially for disposable surgical gowns, is shown schematically in FIGS. 4–6. Layered sleeve material 60 is produced from at least three layers of materials, base sleeve material 30, barrier material 31, and sleeve lining material 32. These three materials are fed to the manufacturing process, preferably from roll stocks 40, 41, and 42, as material source layers having a substantially constant width, an indefinite length, and a small (compared to its width and length) thickness. Each of the material source layers has opposed surfaces, the distance between which defines its thickness, and opposed edges, the distance between which defines its width. Base sleeve material 30 has opposed surfaces 76 and 77 and opposed edges 78 and 79. Barrier material 31 has opposed surfaces 86 and 87 and opposed edges 88 and 89. Sleeve lining material 32 has opposed surfaces 96 and 97 and opposed edges 98 and 99. The width of barrier material 31 is substantially less than the width of base sleeve material 30. The width of sleeve lining material 32 is preferably slightly greater than the width of barrier material 31 but also substantially less than the width of base sleeve material 30.

The material source layers are fed concurrently to the sleeve manufacturing process with the lengths of the materials substantially parallel to one another. The material source layers are fed, preferably onto a conveyor, such that they are layered, preferably with base sleeve material 30 on the bottom and barrier material 31 between base sleeve material 30 and sleeve lining material 32. Barrier material 31 and sleeve lining material 32 are substantially centrally located across the width of base sleeve material 30 such that surface 87 of barrier material 31 is proximate to surface 76 of base sleeve material 30 and surface 86 of barrier material 31 is proximate to surface 97 of sleeve lining material 32. Preferred widths for the three materials are about 82 cm for base sleeve material 30, about 37 cm for barrier material 31, and about 41 cm for sleeve lining material 32.

The proximate surfaces of the material source layers are secured to one another thus forming layered sleeve material 60. The material source layers are preferably secured to one another by adhering edges 98 and 99 of sleeve lining material 32 to base sleeve material 30 such that barrier material 31 is encased between sleeve lining material 32 and base sleeve material 30 but is substantially free from adherence to either. The material source layers can be secured in this manner by continuously applying strips of adhesive 33 and 34 on surface 76 of base sleeve material 30 (or, alternatively, on surface 97 of sleeve lining material 32), such that when the materials are adhered together, adhesive strips 33 and 34 are near edges 98 and 99 of sleeve lining material 32. Adhesive strips 33 and 34 are placed so as to avoid contact with barrier material 31 when the three material source layers are layered together.

Individual sleeve sections, e.g. 50, 51, and 52, are cut from layered sleeve material 60. The individual sleeve sections are cut such that adjacent sections, e.g. 52 is adajacent to 51 and 51 is adjacent to 50, are cut along the length of layered sleeve material 60 such that each section is a mirror image of its adjacent sections.

FIG. 5 is a plan view of individual sleeve section 50 which is preferably quadrangular in shape, having a first pair of opposed edges 38 and 39 and a second pair of opposed edges 91 and 92. It is preferred that opposed edges 38 and 39 be substantially equal in length. Individual sleeve section 50 is preferably regular trapezoidal in shape with parallel, unequal-length opposed edges 91 and 92 and non-parallel, equal-length opposed edges 38 and 39.

Individual sleeve sections 52, 51 and 50 are preferably cut sequentially along the length of layered sleeve material 60. The sleeve sections are located on layered sleeve material 60 with alternate adjacent sections having their longer parallel edges, e.g. edge 91 for individual sleeve section 50, alternately coincidental with opposed edges 78 and 79 of base sleeve material 30. The individual sleeve sections are preferably located with alternate sections having their shorter parallel edges, e.g. edge 92 of individual sleeve section 50, alternately substantially coincidental with opposed edges 99 and 98 of sleeve lining material 32. For each of the individual sleeve sections (e.g. 50), the shorter parallel edge (e.g. 92) is coincidental with the edge (e.g. 99) of sleeve lining material 32 which is farthest from the edge (e.g. 78) of base sleeve material 30 with which the long parallel edge (e.g. 91) of the sleeve section (e.g. 50) is coincidental. Utilization of this alternating cutout pattern, as shown in FIG. 4, results in all of the lower sleeve portions being made from central, three-layer portion 35 of layered sleeve material 60. The upper sleeve portions are made from side portions 36 and 37 of layered sleeve material 60; side portions 36 and 37 preferably consist essentially of only a layer of base sleeve material 30. The scrap portion, e.g. 54 or 55, associated with each individual sleeve section, e.g. 51 or 52, respectively, is minimal and also consists of a layer of base sleeve material only.

Preferred regular trapezoidal section 50, which would be used to construct one gown sleeve, is shown in fragmentary plan view in FIG. 5. Typical dimensions for trapezoidal section 50 are a length 82 (distance between parallel edges 91 and 92) of about 61 cm., a width 83 at upper arm edge 91 of about 72 cm., and a width 81 at lower arm edge 92 of about 29 cm.

A sleeve is constructed from each individual sleeve section. For a quadrangular shaped sleeve section, the sleeve section is rolled such that one pair of opposed edges overlap and the seam is constructed by adhering the overlapped edges to one another. For example, preferred trapezoidal sleeve section 50 is rolled such that nonparallel opposed edges 38 and 39 overlap as shown in FIG. 6, and a longitudinal sleeve seam is made by sealing overlapped edges 38 and 39 together, preferably such that all three materials 30, 31 and 32 are attached together in the portion of the seam within the sleeve zone formed by three-layer portion 35 of sleeve section 50. The longitudinal seam can be made by any conventional means, such as by sewing or using adhesive, sewing is preferred. The preferred sleeve construction method results in a sleeve zone with barrier material 31 affixed to base sleeve material 30 and sleeve lining material 32 substantially only along the longitudinal sleeve seam. The sleeve made from sleeve section 50 is then incorporated in a surgical gown by attaching it to the front and side portions of the gown by any conventional means, such as by sewing or using adhesive.

Figure 7:
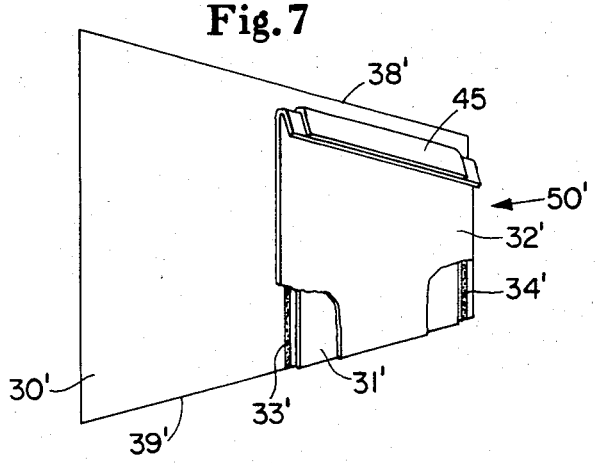
FIG. 7 is a fragmentary perspective view of a preferred individual sleeve section depicting the first step of an alternate preferred process for constructing a sleeve seam.
Figure 8:
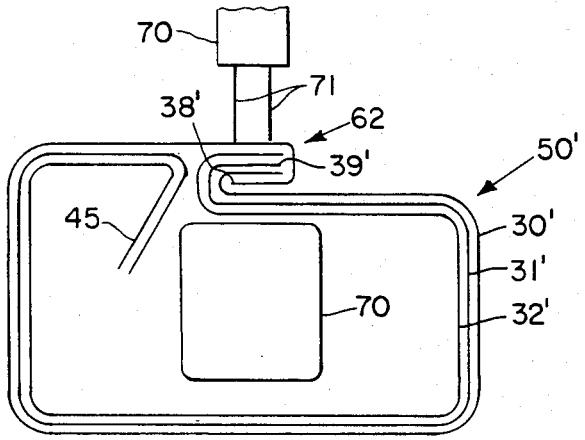
FIG. 8 is a cross-sectional view of the lower part of the individual sleeve section of FIG. 7 undergoing a preferred process for constructing its seam.
Figure 9:
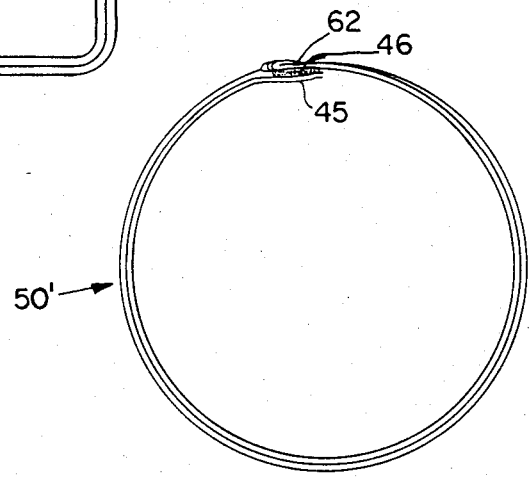
FIG. 9 is a cross-sectional view of the lower part of a zoned gown sleeve, the seam of which was constructed by the alternate preferred process depicted in FIGS. 7 and 8.

An alternate preferred method for constructing longitudinal seams of surgical gown sleeves, which could be utilized to construct such sleeves from trapezoidal or rectangular sections of fabric laminates, is illustrated in FIGS. 7–9. This preferred sleeve seaming method can be used when the sleeve has a zone comprised of a layered sleeve material where one of the layers is a water-repellent or water-impermeable material. This sleeve seaming method provides a sewn longitudinal seam for the sleeve; a sewn seam is generally preferred because it usually provides better strength than seams achieved by adhesive or other means. However, a sewn seam contains small needle holes which provide pathways for liquids to penetrate the sleeve fabric. The preferred sleeve seaming method illustrated in FIGS. 7–9 eliminates such easy pathways for liquid penetration of the fabric for the portion of the seam within the sleeve zone by retaining a flap of the water-repellent or water-impermeable layer out of the sewn seam, and thereafter, overlapping such portion of the seam with the flap and securing the flap over the sewn seam by means other than sewing, e.g. by the use of adhesive or by heat sealing, thus covering the needle holes with the flap.

The preferred sleeve seaming method is illustrated in FIGS. 7–9 utilizing regular trapezoidal section 50' of a layered sleeve material such as layered sleeve material 60 of FIG. 4. However, the seam construction method described herein can be used for constructing seams of any layered material having at least one water-repellent or water-impermeable layer.

For this preferred method of sleeve seaming, adhesive strips 33' and 34' along the edges of sleeve lining material 32' are not continuous, but instead, a gap of about one inch is left at certain intervals. These intervals are controlled such that sleeve lining material 32' is not secured to base sleeve material 30' along one of the nonparallel opposed trapezoidal edges 38' or 39'. In FIG. 7, the non-secured portion is shown along edge 38', thus forming flap 45 comprised of barrier material 31' and sleeve lining material 32'.

The sleeve seam is preferably sewn by sewing machine 70 as shown in FIG. 8 which depicts a cross-sectional view of the lower sleeve portion of trapezoidal section 50' being sewn. Flap 45 of barrier material 31' and sleeve lining material 32' is turned back so that it is not included in sewn seam 62. Edge 39' is folded so that all three layers of material are included in sewn seam 62, and they are interposed with a fold of the base sleeve material 30' portion only of edge 38'. These interposed folded edges are preferably dual stitched with two needles 71 of sewing machine 70. After seam 62 is sewn, flap 45 is unfolded such that it covers sewn seam 62. Flap 45 is adhered to the seam area using adhesive 46 as shown in FIG. 9. (Other conventional means, such as heat sealing, could be used with other types of water-repellent or water-impermeable material(s).) The seam thus created has a layer of barrier material 31', having no needle holes, which covers the inside of sewn seam 62.

TEST PROCEDURES

The test procedures used to determine the properties of the nonwoven fabrics described herein are as follows:

Air Porosity Test

The test for air porosity of the nonwoven fabrics conforms to ASTM test method D-737, with the exception that the material to be tested is conditioned at 23° C.±1° C. and 50%±2% relative humidity for a minimum of 12 hours prior to testing. The air porosity is reported as liters per second per square meter at 12.7 mm $H_2O$ differential pressure. A high volume is desired.

Liquid Column Strikethrough Resistance Test

The liquid strikethrough resistance test is a method for determining the water pressure in millimeters of water at which water penetrates a material at a specified fill rate and with the water and material at a specified temperature.

The strikethrough tester comprises a vertically mounted clear plastic tube with an inside diameter of 50.8 mm±1.6 mm having a flange on the bottom of the tube with rubber gaskets to hold the samples. Each sample consists of at least five individual test specimens cut to 90 mm×90 mm.

Each test specimen is appropriately affixed to the bottom of the tube. Water is introduced into the tube at a filling rate of 617 cc per second giving a rate increase of water pressure of 3.3 mm of water per second. Both the water and the material are conditioned to 23°±1° C. When the first drop of water penetrates the sample specimen, the column height is read for that specimen in millimeters of water. The liquid column strikethrough resistance value for each sample is an average of the values of the five specimens for that sample. A high value is desired.

While particular embodiments of the present invention have been illustrated and described, those skilled in the art will recognize that various changes and modifications can be made without departing from the spirit and scope of the invention. It is intended to cover, in the appended claims, all such modifications that are within the scope of this invention.

What is claimed is:

1. A garment sleeve, said sleeve having a wrist end, an elbow area, and a shoulder end, said sleeve having a zone which extends from a lower end proximate said wrist end of said sleeve to an upper end above said elbow area of said sleeve, said sleeve zone comprising:

(a) an outer layer of base sleeve material;

(b) an inner layer of sleeve lining material;

(c) a mid layer of barrier material, said barrier material being a water-repellent, air-porous nonwoven fabric web, said mid layer being encased between said outer and inner layers;

(d) a first bond around said sleeve at said lower end of said sleeve zone, and a second bond around said sleeve at said upper end of said sleeve zone, said first and second bonds bonding said outer and inner layers to one another, said mid layer being excluded from said first and second bonds.

2. The sleeve of claim 1 wherein said barrier material is a web of microfine hydrophobic fibers, said fibers having a fiber diameter of up to about 10 microns.

3. The sleeve of claim 2 wherein said web is a melt-blown web.

4. The sleeve of claim 3 wherein said sleeve is a disposable surgical gown sleeve, and said base sleeve material is a nonwoven fabric laminate.

5. The sleeve of claim 4 wherein said sleeve lining material is selected from the group consisting of a nonwoven fabric and a nonwoven fabric laminate.

6. The sleeve of claim 1 wherein said melt-blown web has a liquid strikethrough resistance of at least about 200 mm $H_2O$ and an air porosity of at least about 100 l/sec/m$^2$, and said base sleeve material is a water-repellent, abrasion-resistant nonwoven fabric laminate.

7. The sleeve of claim 3 wherein said melt-blown web has a liquid strikethrough resistance of at least about 250 mm $H_2O$, an air porosity of at least about 250 l/sec/m$^2$, and a basis weight of from about 10 g/m$^2$ to about 30 g/m$^2$.

8. The sleeve of claim 5 wherein said melt-blown web has a liquid strikethrough resistance of at least about 380 mm $H_2O$, an air porosity of at least about 400 l/sec/m$^2$, and a basis weight of from about 10 g/m$^2$ to about 30 g/m$^2$.

9. The sleeve of claim 8 wherein said base sleeve material has a liquid strikethrough resistance of at least about 150 mm $H_2O$, an air porosity of at least about 250 l/sec/m$^2$, and a basis weight of no more than about 60 g/m$^2$; and said sleeve lining material is a spunbond web having a basis weight of from about 20 g/m$^2$ to about 35 g/m$^2$.

10. The sleeve of claim 1 wherein said sleeve zone comprises a longitudinal seam such that said outer layer, said inner layer, and said mid layer are attached together in said zone seam, said mid layer being affixed to said outer layer and said inner layer substantially only along said zone seam.

11. The sleeve of claim 5 wherein said sleeve zone comprises a longitudinal seam such that said outer layer, said inner layer, and said mid layer are attached together in said zone seam, said mid layer being affixed to said outer layer and said inner layer substantially only along said zone seam.

12. The sleeve of claim 9 wherein said sleeve zone comprises a longitudinal seam such that said outer layer, said inner layer, and said mid layer are attached together in said zone seam, said mid layer being affixed to said outer layer and said inner layer substantially only along said zone seam.

13. The sleeve of claim 1 wherein said sleeve comprises a sewn longitudinal seam and a flap of said mid layer, said flap overlapping a portion of said seam within said sleeve zone, said flap being secured over said seam portion by means other than sewing, whereby needle holes in said seam portion are covered by said flap.

14. The sleeve of claim 4 wherein said sleeve comprises a sewn longitudinal seam and a flap of said mid layer, said flap overlapping a portion of said seam within said sleeve zone, said flap being secured over said seam portion by means other than sewing, whereby needle holes in said seam portion are covered by said flap.

15. A process for manufacture of garment sleeves from at least three layers of materials, each of said materials being fed to said process as a material source layer having a substantially constant width, an indefinite length, and a thickness, each of said material source layers having opposed surfaces, the distance between which defines said thickness, and opposed edges, the distance between which defines said width comprising:

(a) feeding a base sleeve material;

(b) feeding concurrently with said base sleeve material a barrier material, said barrier material being fed with its length substantially parallel to the length of said base sleeve material, said barrier material having a width substantially less than the width of said base sleeve material;

(c) feeding concurrently with said base sleeve material and said barrier material, a sleeve lining material, said sleeve lining material being fed with its length substantially parallel to the length of said base sleeve material, said sleeve lining material having a width greater than the width of said barrier material but substantially less than the width of said base sleeve material;

(d) layering said base sleeve material, said barrier material, and said sleeve lining material such that said barrier material is located between said base sleeve material and said sleeve lining material with the opposed surfaces of said barrier material proximate to one surface of each of said base sleeve material and said sleeve lining material, and such that both said barrier material and said sleeve lining material are substantially centrally located across the width of said base sleeve material;

(e) securing the proximate surfaces of said barrier material and said base sleeve material and said sleeve lining material to one another, thus forming a layered sleeve material, said securing of said proximate surfaces being achieved by adhering said sleeve lining material along its opposed edges to said base sleeve material, whereby said barrier material is contained between said sleeve lining material and said base sleeve material but is substantially free from adherence to either said sleeve lining material or said base sleeve material;

(f) cutting individual sleeve sections from said layered sleeve material, said individual sleeve sections being cut such that adjacent sections are cut along the length of said layered sleeve material, such sections being cut such that each section is a mirror image of its adjacent sections; and (g) constructing a sleeve from each individual sleeve section.

16. The process of claim 15 wherein said sleeve sections are regular trapezoidal in shape having parallel, unequal-length opposed edges and non-parallel, equal-length opposed edges and are cut sequentially from said layered sleeve material such that alternate adjacent sections have their longer parallel edges alternately coincidental with the opposed edges of said base sleeve material, and have their shorter parallel edges alternately substantially coincidental with the opposed edges of said sleeve lining material, such that for each said section, said shorter parallel edge is coincidental with the edge of said sleeve lining material which is farthest from the edge of said base sleeve material with which the long parallel edge of said each section is coincidental, whereby subsequent to constructing said sleeve, said sleeve has an upper portion consisting essentially of said base sleeve material and a lower portion comprising said base sleeve material, said barrier material and said sleeve lining material.

17. The process of claim 16 wherein said barrier material is a melt-blown web.

18. The sleeve of claim 17 wherein said base sleeve material is a nonwoven fabric laminate.

19. The sleeve of claim 18 wherein said sleeve lining material is selected from the group consisting of a nonwoven fabric and a nonwoven fabric laminate.

* * * * *

UNITED STATES PATENT AND TRADEMARK OFFICE

CERTIFICATE OF CORRECTION

PATENT NO. : 4,504,978

DATED : March 19, 1985

INVENTOR(S) : Paul E. Gregory, Jr. and Roger N. White

It is certified that error appears in the above-identified patent and that said Letters Patent are hereby corrected as shown below:

Title Page, the Assignee, should read:
--Assignee: The Procter & Gamble Company, Cincinnati, Ohio--

Column 1, at line 57: delete "treated to" and insert --treated for--

Column 6, at line 47: delete "enchanced" and insert --enhanced--

Signed and Sealed this

*Fifteenth* Day of *October 1985*

[SEAL]

*Attest:*

*Attesting Officer*

DONALD J. QUIGG

*Commissioner of Patents and Trademarks—Designate*